United States Patent [19]

Kappler et al.

[11] 3,969,282

[45] July 13, 1976

[54] ACIDIC SURFACTANT COMPOSITION, STOCK SURFACTANT SOLUTION PREPARED THEREFROM, AND METHOD OF WASHING SOILED SUBSTRATES EMPLOYING THE SAME

[75] Inventors: Frank R. Kappler, Wyandotte; John D. Ciko, Allen Park; John J. Cramer, Wyandotte, all of Mich.

[73] Assignee: BASF Wyandotte Corporation, Wyandotte, Mich.

[22] Filed: Dec. 23, 1974

[21] Appl. No.: 535,260

[52] U.S. Cl. ..... 252/559; 252/95; 252/100; 252/142

[51] Int. Cl.[2] ..... C11D 1/22; C11D 1/831

[58] Field of Search ..... 252/89, 558, 559, 540, 252/DIG. 14, DIG. 1, 95, 100, 142

[56] References Cited

UNITED STATES PATENTS

| | | | |
|---|---|---|---|
| 2,827,484 | 3/1958 | Carlson et al. | 260/505 |
| 3,068,279 | 12/1962 | Groves et al. | 260/505 |
| 3,218,260 | 11/1965 | Lewandowski | 252/142 |

FOREIGN PATENTS OR APPLICATIONS

| | | |
|---|---|---|
| 274,388 | 3/1967 | Australia |
| 870,458 | 6/1941 | United Kingdom |
| 885,870 | 12/1961 | United Kingdom |
| 917,432 | 2/1963 | United Kingdom |
| 293,004 | 3/1971 | U.S.S.R. |

OTHER PUBLICATIONS

Kastra, Def. Pub. of Ser. No. 182,863, Filed Sept. 22, 1971, Def. Pub. No. T903,009.

*Primary Examiner*—P.E. Willis, Jr.
*Attorney, Agent, or Firm*—Bernhard R. Swick; L. S. Van Landingham, Jr.; Robert E. Dunn

[57] ABSTRACT

An acidic, stable, homogeneous, mobile liquid, biodegradable surfactant composition is provided which consists essentially of 1. at least one liquid hydrophilic nonionic surfactant, 2. at least one substantially salt free liquid biodegradable alkyl benzene sulfonic acid surfactant corresponding to the structural formula:

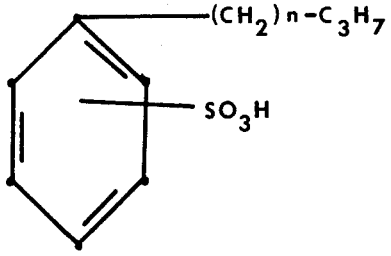

wherein *n* is an integer having a numerical value of from 3 to 14, 3. about 0.0001–1% by weight of hydrogen peroxide, and 4. about 0–95% by weight of water. The surfactant composition contains a weight ratio of surfactant (1) to surfactant (2) from 1:5 to 5:1, and surfactant (1) has hydrophilic properties whereby the surfactant composition is stable and remains homogeneous in the absence of an added hydrotrope. The hydrogen peroxide is present in an amount to control obnoxious odors and the use of an expensive perfume to mask odors is not necessary. Acidic stock surfactant solutions which are compatible with alkaline aqueous washing media may be prepared by diluting the surfactant composition with water. The acidic surfactant composition and/or stock solution may be admixed with an alkaline aqueous medium containing a dissolved substance providing ammonion ion, sodium ion, and/or potassium ion in an amount to form the corresponding salt of the alkyl benzene sulfonic acid surfactant and the resulting admixture may be used in washing soiled substrates. The surfactant composition and stock solution are especially useful in laundering textile materials and, when used for this purpose, a very high degree of soil removal is achieved. The surfactant composition and stock solution do not require water softening agents when washing in hard water.

41 Claims, No Drawings

ACIDIC SURFACTANT COMPOSITION, STOCK SURFACTANT SOLUTION PREPARED THEREFROM, AND METHOD OF WASHING SOILED SUBSTRATES EMPLOYING THE SAME

THE BACKGROUND OF THE INVENTION

1. The Field of the Invention

The present invention broadly relates to novel surfactant compositions and a method of washing soiled substrates therewith. In some of its more specific variants, the invention is concerned with acidic liquid surfactant compositions and the use thereof in washing textile materials and soiled substrates in general.

2. The Prior Art

Concentrated liquid synthetic detergents possess a number of advantages which are attractive from the standpoints of convenience and efficiency. This is especially true when operating modern institutional laundry equipment of the type wherein bulk liquid washing chemicals are stored in auxiliary tanks and added automatically to the washer through feed conduits at predetermined stages in the washing cycle. In some instances, the concentrated liquid detergent is added directly to the washer, and in other instances it is diluted with water to form a stock solution which is then added.

A commercially successful liquid detergent composition for sale to the institutional laundry industry should possess a combination of desirable properties. The liquid detergent should be concentrated to reduce shipping and storage costs. It should also be homogeneous, stable, and sufficiently fluid and mobile to flow easily through the detergent feed conduit. A solid precipitate, gel, or other nonhomogeneous phase should not form therein during storage or use, nor should deposits form on the internal surfaces of the detergent storage tank and feed conduits. The concentrated detergent should be easily diluted with water prior to use and/or capable of being added directly to the wash water without adverse effects. The composition should give good detergency values in soft water and preferably also in hard water, and it should not require an expensive additive which increases costs without increasing the detergency value such as a hydrotrope or perfume. It is also essential from the pollution control standpoint that the detergent be biodegradable in order to meet the requirements of pollution control laws.

Alkyl benzene sulfonic acid detergents in the free acid or salt form are widely used at the present time and several prior art liquid detergent compositions have been proposed which are prepared therefrom. However, the resulting compositions are deficient in one or more of the above mentioned desirable properties. A number are not biodegradable nor concentrated. When concentrated, the compositions contain an expensive hydrotrope which has little or no detergency value and yet is essential in preparing and maintaining a homogeneous stable solution of the ingredients. Some of the concentrated acidic detergent compositions are not fully compatible with alkaline wash water and thus should not be added directly to the washer, or they require agitation and/or heating at the time of diluting to produce a stock solution which then may be added to the water. Still other of the aforesaid detergent compositions are adversely affected by hard water and/or do not give outstanding detergency values for other reasons, and perfumes or other expensive ingredients are required for esthetic purposes. Accordingly, the art has long sought an entirely satisfactory liquid composition containing an alkyl benzene sulfonic acid which overcomes the aforementioned deficiencies and which possesses the desirable properties mentioned hereinbefore to an unusual degree.

THE SUMMARY OF THE INVENTION

The present invention provides a novel acidic liquid surfactant composition which is stable, homogeneous, mobile and biodegradable. The composition is prepared from at least two surfactants, one being a liquid hydrophilic nonionic surfactant and the other being a liquid alkyl benzene sulfonic acid surfactant. The two surfactants are carefully selected and have properties defined more fully hereinafter whereby the resultant surfactant composition is stable and remains homogeneous in the absence of an added hydrotrope.

The obnoxious odor characteristic of prior art surfactant compositions containing an alkyl benzene sulfonic acid is controlled by addition of hydrogen peroxide thereby eliminating the need for an expensive perfume as an odor masking agent. The concentrated composition may or may not contain water, and it may be diluted to prepare an acidic stock surfactant solution which is compatible with alkaline wash water. Either the concentrated surfactant composition or the dilute stock solution prepared therefrom may be reacted with a substance providing ammonium ion, sodium ion and/or potassium ion to form the corresponding salt of the alkyl benzene sulfonic acid surfactant, and then used in laundering textile materials or in washing other types of soiled substrates in the absence of a water softening agent.

The detailed description of the preferred variants of the invention and the specific Examples appearing hereinafter may be referred to for a more complete and comprehensive understanding of the invention.

THE DETAILED DESCRIPTION OF THE INVENTION INCLUDING PREFERRED VARIANTS THEREOF

The acidic liquid surfactant composition of the present invention consists essentially of at least one liquid nonionic surfactant, at least one liquid alkyl benzene sulfonic acid surfactant, and hydrogen peroxide. Water also may be present when desired. As will be described more fully hereinafter, certain specific types of liquid nonionic surfactants and liquid alkyl benzene sulfonic acid surfactants having properties essential to the surfactant composition must be selected and then used in combination in the disclosed quantities. All quantities mentioned herein are calculated on a weight basis unless indicated to the contrary.

The nonionic surfactants are generally the polyoxyalkylene adducts of hydrophobic bases wherein the oxygen/carbon atom ratio in the oxyalkylene portion of the molecule is greater than 0.40. This oxyalkylene portion of the molecule should constitute at least 60%, and preferably at least 65%, of the weight of the molecule. Alkylene oxides which may be condensed with hydrophobic bases to provide a polyoxyalkylene portion having an oxygen/carbon atom ratio greater than 0.40 include ethylene oxide, butadiene dioxide and glycidol, and mixtures thereof with or without minor amounts of propylene oxide, butylene oxide, amylene oxide, styrene oxide and other higher molecular weight alkylene oxides. Ethylene oxide, for example, may be condensed with the hydrophobic base in an amount sufficient to impart the desired water dispersibility, solubility, hydrophilicity and surface active properties. The exact amount of ethylene oxide condensed with the hydrophobic base will depend upon the chemical characteristics of the specific base and is readily apparent to those skilled in the synthesis of oxyalkylene surfactant condensates.

Typical hydrophobic bases which may be condensed with ethylene oxide to prepare nonionic surface active agents include mono- and polyalkyl phenols, polyoxypropylene condensed with a base having from about 1 to 6 carbon atoms and at least one reactive hydrogen atom, fatty acids, fatty amines, fatty amides and fatty alcohols. Hydrocarbon ethers such as the benzyl and lower ethers of polyoxyethylene condensates may be employed.

Other nonionic surfactants are the polyoxyethylene condensates of alkyl phenols having from about 6 to 20 carbon atoms in the alkyl portion and from about 5 to 20 ethoxy groups in the polyoxyethylene radical. The alkyl substituent on the aromatic nucleus may be octyl, diamyl, n-dodecyl, polymerized propylene such as propylene trimer and tetramer, isoctyl, nonyl, etc. The benzyl ethers of the polyoxyethylene condensates of monoalkyl phenols may be used and a typical product corresponds to the formula:

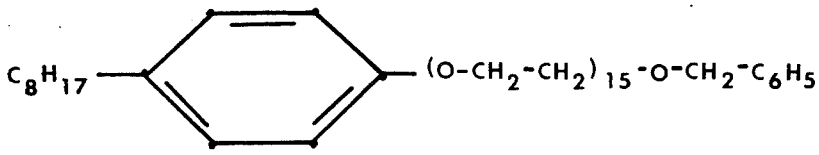

Higher polyalkyl oxyethylated phenols corresponding to the formula:

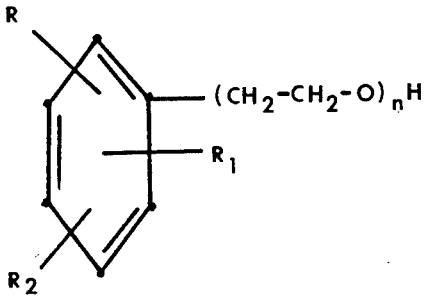

wherein R is hydrogen or an alkyl radical having from about 1 to 12 carbon atoms, $R_1$ and $R_2$ are alkyl radicals having from about 6 to 16 carbon atoms and $n$ has a value from about 10 to 40 also may be used as nonionic surfactants. A typical oxyethylated polyalkyl phenol is dinonyl phenol condensed with 14 moles of ethylene oxide.

Still other nonionic surface active agents are cogeneric mixtures of conjugated polyoxyalkylene compounds containing in their structure at least one hydrophobic oxyalkylene chain in which the oxygen/carbon atom ratio does not exceed 0.40 and at least one hydrophilic oxyalkylene chain in which the oxygen/carbon atom ratio is greater than 0.40.

Polymers of oxyalkylene groups obtained from propylene oxide, butylene oxide, amylene oxide, styrene oxide, mixtures of such oxyalkylene groups with each other and with minor amounts of polyoxyalkylene groups obtained from ethylene oxide, butadiene dioxide, and glycidol are illustrative of hydrophobic oxyalkylene chains having an oxygen/carbon atom ratio not exceeding 0.40. Polymers of oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide and styrene oxide are illustrative of hydrophilic oxyalkylene chains having an oxygen/carbon atom ratio greater than 0.40.

Among the conjugated polyoxyalkylene compounds which may be used are those which correspond to the formula:

$$Y-(C_3H_6O)_n-(C_2H_4O)_m-H$$

wherein Y is the residue of an organic compound having from about 1 to 6 carbon atoms and one reactive hydrogen atom, $n$ has an average value of at least about 6.4 as determined by hydroxyl number, and $m$ has a value such that the oxyethylene portion constitutes about 60 to 90 weight percent of the molecule. These surface active agents are more particularly described in U.S. Pat. No. 2,677,700.

Other conjugated polyoxyalkylene surface active agents correspond to the formula:

$$Y[C_3H_6O)_n-(C_2H_4O)-_mH]x$$

wherein Y is the residue of an organic compound having from about 2 to 6 carbon atoms and containing $x$ reactive hydrogen atoms in which $x$ has a value of at least about 2, $n$ has a value such that the molecular weight of the polyoxypropylene hydrophobic base is at least about 900, and $m$ has a value such that the oxyethylene content of the molecule is from about 60 to 90 weight percent. Compounds falling within the scope of the definition for Y include, for example, propylene glycol, glycerine, pentaerythritol, trimethylolpropane, ethylenediamine and the like. As already noted, the oxypropylene chains may contain small amounts of ethylene oxide and the oxyethylene chains also may contain small amounts of alkylene oxides such as propylene oxide and butylene oxide. These compositions are more particularly described in U.S. Pat. No. 2,674,619. Additional conjugated polyoxyalkylene surface active agents correspond to the formula.

$$P[C_3H_6O)_n-(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58, and $m$ has a value such that the oxyethylene content of the molecule is from about 60 to 90 weight percent and the formula:

$$P[C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $m$ has a value such that the molecular weight of the polyoxypropylene portion is at least about 58, and $n$ has a value such that the oxyethylene content of the molecule is from about 60 to 90 weight percent. In either case the oxypropylene chains may contain small amounts of ethylene oxide and the oxyethylene chains may contain small amounts of alkylene oxides such as propylene oxide, butylene oxide and higher alkylene oxides containing 8 to 18 carbon atoms in the alkyl chain.

Thus, cogeneric mixtures of conjugated polyoxyalkylene compounds containing in their structure the residue of an active hydrogen-containing compound and at lease one hydrophobic chain or units selected from the group consisting of oxypropylene and oxypropylene-oxyethylene units in which the oxygen/carbon atom ratio does not exceed 0.40 and at least one hydrophilic chain of units selected from the group consisting of oxyethylene and oxyethylene-oxypropylene units in which the oxygen/carbon atom ration is greater than 0.40 are suitable nonionic surface active agents.

Further nonionic surface active agents are the polyoxyethylene esters of higher fatty acids having from about 8 to 22 carbon atoms in the acyl group and from about 8 to 30 ethoxy units in the oxyethylene portion. Typical products are the polyoxyethylene adducts of tall oil, rosin acids, lauric, stearic and oleic acids and the like. Additional nonionic surface active agents are the polyoxyethylene condensates of higher fatty acid amines and amides having from about 8 to 22 carbon atoms in the fatty alkyl or acyl group and about 10 to 30 ethoxy units in the oxyethylene portion. Illustrative products are coconut oil fatty acid amines and amides condensed with about 10 to 30 moles of ethylene oxide.

Other polyoxyalkylene nonionic surface active agents are the alkylene oxide adducts of higher aliphatic alcohols and thioalcohols having from about 8 to 22 carbon atoms in the aliphatic portion and about 3 to 50 oxyalkylene units in the oxyalkylene portion. Typical products are synthetic fatty alcohols, such as n-decyl, n-undecyl, n-dodecyl, n-tridecyl, n-tetradecyl, n-hexadecyl, n-octadecyl and mixtures thereof condensed with 3 to 50 moles of ethylene oxide, a mixture of normal fatty alcohols condensed with 8 to 20 moles of ethylene oxide and capped with benzyl halide or an alkyl halide, a mixture of normal fatty alcohols condensed with 10 to 30 moles of a mixture of ethylene and propylene oxides, a mixture of several fatty alcohols condensed sequentially with 2 to 20 moles of ethylene oxide and 3 to 10 moles of propylene oxide in either order; or a mixture of normal fatty alcohols condensed with a mixture of propylene and ethylene oxides, in which the oxygen/carbon atom ratio is less than 0.40, followed by a mixture of propylene and ethylene oxides in which the oxygen/carbon atom ratio is greater than 0.40, or a linear secondary alcohol condensed with 3 to 30 moles of ethylene oxide, or a linear secondary alcohol condensed with a mixture of propylene and ethylene oxides, or a linear secondary alcohol condensed with a mixture of ethylene, propylene, and higher alkylene oxides.

The presently preferred nonionic surfactants are alkoxylates of aliphatic alcohols having the following formula:

$$R-O-(A)_n-H$$

wherein R is the organic residue of an aliphatic alcohol or mixtures thereof having 8–20 carbon atoms in the aliphatic portion, A is a plurality of oxyalkylene groups, and $n$ is an integer such that the oxyalkylene groups constitute at least 60% by weight of the compound, and preferably at least 65%. Usually A represents oxyethylene groups, oxypropylene groups, or mixtures thereof. The oxyalkylene groups generally constitute more than 60% and up to 85% by weight of the compound, and preferably about 70% to 80%. Nonionic surfactants of this type may be prepared either by using a random mixture of oxyalkylene groups or by sequential addition thereof. When both oxyethylene groups and oxypropylene groups are employed, they may be present in a respective weight ratio of 1:2 to 7:1. The above nonionic surfactants are more particularly described in U.S. Pat. Nos. 3,340,309, 3,504,041 and 3,770,701, which are incorporated herein by reference.

It is understood that a nonionic surfactant is selected which has hydrophilic properties whereby the liquid surfactant composition described herein is stable and remains homogeneous in the absence of an added hydrotrope. The nonionic surfactant should contain sufficient oxyethylene groups to provide the desired degree of hydrophilic properties. In most instances, the molecule should contain approximately 60–95% by weight of oxyethylene groups, and preferably from about 70% to about 80% by weight.

The liquid biodegradable alkyl benzene sulfonic acid surfactant used in practicing the invention corresponds to the following structural formula:

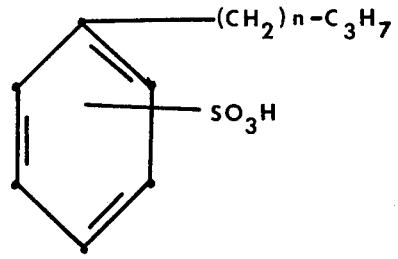

wherein $n$ is an integer having a numerical value of 3 to 14 and preferably from about 6 to 11. Especially preferred alkyl benzene sulfonic acid surfactants have an average numerical value for $n$ of approximately 12.

The alkyl benzene sulfonic acid surfactant should be in the free acid form as distinguished from the salts thereof. Otherwise acceptable results are not obtained due to precipitation or other adverse effects such as clouding or gelling.

Processes for the preparation of the foregoing alkyl benzene sulfonic acid surfactants are well known. The commercial products usually contain a mixture of compounds having the aforementioned general formula, wherein the numerical value of $n$ varies from molecule to molecule and thus is an average value. For instance, one commercially available dodecylbenzene sulfonic acid has a minimum of 70% by weight of molecules wherein $n$ is 8 or 9, and up to 30% by weight of molecules wherein $n$ is 6, 7, 10 and/or 11 to thereby give an average value for $n$ of approximately 11.3. Surfactants of this type are biodegradable liquids and are especially desirable in practicing the present invention.

The nonionic surfactant and the alkyl benzene sulfonic acid surfactant are present in the composition in a weight ratio varying from 1:5 to 5:1, and preferably from about 1:2 to 2:1. Best results are usually achieved when the weight ratio is about 1:1.

The hydrogen peroxide is present in an amount to control the obnoxious odor which is characteristic of alkyl benzene sulfonic acid. As a general rule, the surfactant composition contains about 0.0001–1% by weight of hydrogen peroxide, and preferably about 0.01–0.5%. The best results are usually achieved when about 0.1% by weight of hydrogen peroxide is present. The hydrogen peroxide is preferably added in the form of a commercially available aqueous solution containing, for example, about 10% to 70% by weight of $H_2O_2$. Aqueous solutions of hydrogen peroxide are compatible with the detergent composition and do not contribute metal ions which react with the free alkyl benzene sulfonic acid to form undesirable salts which in turn cause the precipitation of the surfactant.

In addition to the above mentioned essential ingredients, the surfactant composition also may contain water in an amount up to about 95% by weight. Usually at least 30% by weight of water should be present, and preferably about 50–85% by weight. For most commercial uses, the best results are usually achieved when the composition contains about 70% by weight of water. Ordinary tap water is satisfactory, but distilled or deionized water may be used if desired.

The resulting concentrated liquid acidic surfactant composition is stable, homogeneous, mobile and biodegradable. It may be stored in auxiliary tanks awaiting use for an indefinite period of time in the concentrated form in the absence of an added hydrotrope. The concentrated surfactant may be added to alkaline wash water as it is compatible therewith. The concentrated surfactant also may be diluted with any desired amount of water to produce an acidic stock surfactant solution which is likewise homogeneous, stable, mobile and compatible with alkaline aqueous washing media. The concentrated surfactant or the diluted stock solution may be added directly to the addition wheel of a commercial washer. When diluting the concentrated surfactant, it is not necessary to agitate or heat the admixture to produce a homogeneous solution. The concentrated surfactant composition forms a homogeneous stable solution upon adding water thereto and the diluted surfactant may be stored indefinitely in auxiliary tanks without the formation of a precipitate, gel, or other non-homogeneous phase. The concentrated and diluted surfactant are sufficiently mobile and fluid to allow transfer through the conduits normally used for adding liquid washing chemicals to commercial laundry equipment and insoluble deposits do not form on the internal surfaces of conduits and tanks in contact therewith.

The concentrated surfactant composition or the diluted stock surfactant solution may be used in washing soiled substrates such as textile materials. Preferably, prior to washing the soiled substrates, the surfactant composition is reacted with a substance providing at least one ion selected from the group consisting of ammonium ion, sodium ion, and potassium ion in an amount to form the corresponding salt of the alkyl benzene sulfonic acid. The salt forming reaction may occur in situ, such as when the surfactant composition and alkaline washing chemicals are added to a commercial washer. Commercial washers are usually operated at a wash water pH value of about 10.5 to 11.5 and thus alkaline washing chemicals such as sodium carbonate, alkali metal hydroxide or aqueous ammonia are normally added to the fresh wash water. In such instances, ammonium, sodium or potassium ion is available for reaction in situ with the free alkylbenzene sulfonic acid surfactant to thereby convert it to the corresponding salt. The resulting ammonium or alkali metal alkyl benzene sulfonic acid salt is then available for use in washing the soiled substrates.

The general method of washing a soiled substrate is otherwise in accordance with prior art practice. For instance, following the reaction to produce the salt form of the surfactant, the resulting aqueous washing medium may be intimately contacted with the soiled substrate under conditions whereby at least a portion of the soil is removed. The invention is especially useful in washing soiled textile materials, which may be in the form of fibrous or unwoven materials such as roving and thread, woven materials such as cloth, or clothing and other articles prepared therefrom. As is well known in the laundry art, usually the soiled textile material is immersed in an agueous washing medium in the presence of a surfactant composition and is agitated therein under conditions whereby the soil is removed.

The surfactant composition of the present invention is further characterized by exceptionally good detergency values and an ability to remove soil substantially completely from textile materials in a single washing. The surfactant compositions and stock solutions also are not affected by hard water and thus a water softening agent is not needed.

The foregoing detailed description and the following specific Examples are for purposes of illustration only and are not intended as being limiting to the spirit or scope of the appended claims.

EXAMPLE I

Five detergent formulations were prepared from commercial dodecylbenzene sulfonic acid, a nonionic surfactant and water. The commercial dodecylbenzene sulfonic acid (LAS acid) contained a minimum of 70% by weight of molecules wherein the linear alkyl substituent contained 11 or 12 carbon atoms, and up to 30% by weight of molecules wherein the linear alkyl substituent contained 9, 10, 13, or 14 carbon atoms to thereby provide an average carbon chain length in the linear alkyl substituent of 11.3 carbon atoms. The nonionic detergent was an adduct of 22% by weight of primary alcohols containing 12–15 carbon atoms and heteric 2:1 propylene oxide/ethylene oxide having a molecular weight of up to 350 plus heteric 2:1 ethylene oxide/propylene oxide having a molecular weight of up to 965. The ratios of the two surfactants were varied between 1:5 and 5:1 and the pH of each formulation was determined. The data on the five detergent formulations appear below in Table I.

TABLE I

| Formulation No. | DETERGENT FORMULATIONS INGREDIENT (WEIGHT %) | | | pH of Formulation |
|---|---|---|---|---|
| | Water | LAS acid | Nonionic Detergent | |
| 1 | 70 | 5 | 25 | 1.7 |
| 2 | 70 | 10 | 20 | 1.5 |
| 3 | 70 | 15 | 15 | 1.4 |
| 4 | 70 | 20 | 10 | 1.3 |
| 5 | 70 | 25 | 5 | 1.2 |

The above prepared detergent formulations had the characteristic odor of alkyl benzene sulfonic acid. The odor could be controlled by addition of 0.1% of hydrogen peroxide.

The above five detergent formulations were tested under identical conditions following standard prior art test procedures. Launder-Ometer washes were made for 15 minutes at 160°F using wash water containing 0.24% by weight of sodium metasilicate or ARLAC in combination with 0.12% by weight of a detergent formulation. Standard soil test swatches were used to monitor detergency. After washing, the swatches were rinsed, dried for 15 minutes at 105°C in a circulating air oven, and detergency values were calculated from Hunterlab D-40 Reflectometer readings. Percent soil retention and percent tensile strength retention (warp) were determined. The data thus obtained are recorded below in Table II.

TABLE II

| *Test | *Test Swatch | Surfactant Formulation 1 | 2 | 3 | 4 | 5 | *Wash Solution |
|---|---|---|---|---|---|---|---|
| ΔSR | TF1-R | 18.9 | 13.7 | 12.1 | 10.0 | 10.9 | SMS |
| ΔSR | TF1-NR | 15.0 | 8.8 | 7.6 | 5.2 | 2.5 | SMS |
| ΔSR | TF1-C | 10.8 | 6.9 | 6.2 | 5.9 | 5.2 | SMS |
| ΔSR | Empa 101 | 20.7 | 19.5 | 19.6 | 20.3 | 19.6 | SMS |
| ΔSR | BM1 | 21.8 | 23.6 | 25.4 | 25.0 | 25.6 | SMS |
| ΔSR | CMS | 9.3 | 11.2 | 8.4 | 6.7 | 10.1 | SMS |
| %WR | TF1-R | 100 | 99 | 98 | 99 | 99 | SMS |
| %WR | TF1-NR | 102 | 101 | 100 | 99 | 101 | SMS |
| %WR | TF1-C | 98 | 98 | 99 | 98 | 98 | SMS |
| ΔSR | TF1-R | 15.3 | 6.3 | 6.3 | 6.5 | 10.9 | ARLAC |
| ΔSR | TF1-NR | 7.4 | 5.1 | 2.7 | 3.5 | 2.6 | ARLAC |
| ΔSR | TF1-C | 2.0 | 2.5 | 0.9 | 0.1 | 0.1 | ARLAC |
| ΔSR | Empa 101 | 20.0 | 19.1 | 12.0 | 20.2 | 18.2 | ARLAC |
| ΔSR | BM1 | 17.5 | 18.9 | 19.8 | 19.4 | 19.8 | ARLAC |
| ΔSR | CMS | 4.5 | 5.1 | 4.6 | 0.5 | 5.2 | ARLAC |
| %WR | TF1-R | 97 | 98 | 97 | 96 | 97 | ARLAC |
| %WR | TF1-NR | 101 | 98 | 97 | 100 | 96 | ARLAC |
| %WR | TF1-C | 94 | 97 | 96 | 95 | 94 | ARLAC |

*Code for Table II
TF1-R 65/35 polyester cotton fabric with resin finish and carbon soil
TF1-NR 65/35 polyester cotton fabric without resin finish and carbon soil
TF1-C 100% cotton fabric with wash'n wear finish and carbon soil.
Empa-101 Oil base carbon soil on all cotton fabric
BM1-Blood, milk, ink stain on cotton fabric
CMS-Cocoa, milk, sugar stain on cotton fabric
ΔSR — Percent Soil Retention
%WR — Percent Tensile Strength Retention (Warp)
SMS — Water containing 0.24 weight percent of sodium metasilicate and 0.12 weight percent of detergent formulation
ARLAC — Water containing 0.24 weight percent of Arlac and 0.12 weight percent of the detergent formulation.

The data in Table II indicate that all five of the detergent blends of Table I are good detergents for use in washing soiled textile materials.

EXAMPLE II

This example illustrates that the surfactant compositions of the present invention require a nonionic surfactant having pronounced hydrophilic properties. Otherwise, the surfactant composition does not remain stable and homogeneous in the absence of a hydrotrope.

A series of twelve detergent formulations were prepared containing on a weight basis 70 parts of water, 15 parts of the LAS acid described in Example I, and 16 parts of a nonionic surfactant. A different nonionic surfactant was used in each formulation. The twelve formulations differed only with respect to the specific nonionic surfactant that was employed.

The twelve detergent formulations were stored in glass bottles at ambient room temperature over a six weeks period. At the end of the storage period, the twelve formulations were observed and the observations were recorded. The data thus obtained appear below on Table III.

TABLE III

| Detergent Formulation No. | Nonionic Surfactant | Observations after six weeks storage |
|---|---|---|
| 1 | A | Gel |
| 2 | B | Unstable-Two Phases |
| 3 | C | Stable |
| 4 | D | Stable |
| 5 | E | Unstable-Two Phases |
| 6 | F | Stable |
| 7 | G | Stable |
| 8 | H | Stable |
| 9 | I | Stable |
| 10 | J | Unstable-Two Phases |
| 11 | K | Stable |
| 12 | L | Stable |

The oxyalkylene portions of the nonionic surfactants in Detergent Formulations No. 1, 2, 5 and 10 constitute 60% or less by weight of the molecules. Thus, the nonionic surfactant should contain more than 60% by weight of oxyalkylene units if the detergent formulation is to remain stable and homogeneous during storage for long periods of time in the absence of a hydrotrope.

*Nonionic Surfactants

1. Nonionic surfactants A, B, C and D are ethoxylates of a secondary alcohol of 11 to 15 carbon atoms wherein 3, 7, 9 and 12 moles, respectively of ethylene oxide was added.
2. Nonionic Surfactant E is an ethylene oxide adduct of a primary $C_{10-12}$ alcohol containing 60% by weight of ethylene oxide.
3. Nonionic Surfactant F is a heteric 85:15 ethylene oxide/propylene oxide adduct of a primary $C_{10-12}$ alcohol containing 20% by weight of alcohol.
4. Nonionic Surfactant G is a heteric 3:1 ethylene oxide/propylene oxide adduct of a primary $C_{12-15}$ alcohol containing 25% by weight of alcohol.
5. Nonionic Surfactant H is a heteric ethylene oxide/propylene oxide adduct of a primary $C_{10-12}$ alcohol containing by weight, 20% alcohol, 60% ethylene oxide and 20% propylene oxide.
6. Nonionic Surfactant I is an ethylene oxide, propylene oxide adduct of a heteric $C_{12-15}$ primary alcohol containing by weight 33% alcohol, 40% ethylene oxide and 27% propylene oxide.
7. Nonionic Surfactant J is an ethylene oxide adduct of a primary $C_{12-15}$ alcohol containing 40% by weight ethylene oxide.
8. Nonionic Surfactant K is an adduct of 22% by weight $C_{12-15}$ primary alcohol and heteric 2:1 propylene oxide/ethylene oxide of up to 350 molecular weight plus heteric 2:1 ethylene oxide/propylene oxide of up to 965 molecular weight.
9. Nonionic Surfactant L is a heteric ethylene oxide/propylene oxide adduct of a primary $C_{12-15}$ alcohol containing by weight 20% alcohol, 60% ethylene oxide and 20% propylene oxide.

We claim:

1. An acidic stable homogeneous mobile liquid biodegradable surfactant composition consisting essentially of 1. at least one liquid hydrophilic nonionic surfactant, the said nonionic surfactant being a polyoxyalkylene adduct of a hydrophobic base wherein the oxygen/carbon atom ratio in the oxyalkylene portion of the molecule is greater than 0.40 and the said oxyalkylene portion constitutes at least 60% by weight of the said molecule, 2. at least one substantially salt free liquid biodegradable alkyl benzene sulfonic acid surfactant corresponding to the structural formula:

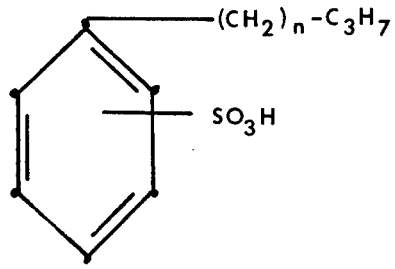

wherein $n$ is an integer having a numerical value of from 3 to 14, 3. about 0.0001–1% by weight of hydrogen peroxide, and 4. about 0–95% by weight of water, the liquid surfactant composition containing a weight ratio of surfactant (1) to surfactant (2) from 1:5 to 5:1, the surfactant (1) having hydrophilic properties whereby the liquid surfactant composition is stable and remains homogeneous in the absence of an added hydrotrope, and the hydrogen peroxide being present in an amount to control obnoxious odors.

2. The liquid surfactant composition of claim 1 wherein the said ratio of surfactant (1) to surfactant (2) is from about 1:2 to 2:1.

3. The liquid surfactant composition of claim 1 wherein about 0.01–0.5% by weight of hydrogen peroxide is present.

4. The surfactant composition of claim 3 wherein the hydrogen peroxide is present in an amount of about 0.1% by weight.

5. The surfactant composition of claim 1 wherein the said ratio of surfactant (1) to surfactant (2) is about 1:1.

6. The liquid surfactant composition of claim 1 wherein the nonionic surfactant comprises an alkoxylate of an aliphatic alcohol corresponding to the structural formula:

$$R-O-(A)_n-H$$

wherein R is the organic residue of at least one aliphatic alcohol having from 8 to 20 carbon atoms, A is at least one oxyalkylene group, and $n$ is an integer having a numerical value such that the oxyalkylene groups constitute more than 60% and up to about 95% by weight of the compound.

7. The liquid surfactant composition of claim 6 wherein the oxyalkylene groups are selected from the group consisting of oxyethylene groups, oxypropylene groups and admixtures thereof, and the oxyalkylene groups constitute at least 65% by weight of the compound.

8. The liquid surfactant composition of claim 7 wherein the oxyalkylene groups constitute from about 70% to 80% by weight of the compound.

9. The liquid surfactant composition of claim 1 wherein $n$ is an integer having a numerical value of from about 6 to 11.

10. The liquid surfactant composition of claim 1 wherein $n$ is an integer having a numerical value of about 9.

11. The liquid surfactant composition of claim 1 wherein at least 30% by weight of water is present.

12. The liquid surfactant composition of claim 1 wherein from about 50% to 85% by weight of water is present.

13. The liquid surfactant composition of claim 6 wherein $n$ is an integer having a numerical value of from about 6 to 11, and at least 30% by weight of water is present in the surfactant composition.

14. The liquid surfactant composition of claim 13 wherein the said ratio of surfactant (1) to surfactant (2) is from about 1:2 to 2:1.

15. The liquid surfactant composition of claim 13 wherein about 0.01–0.5% by weight of hydrogen peroxide is present to control obnoxious odors.

16. The liquid surfactant composition of claim 13 wherein the said oxyalkylene groups are selected from the group consisting of oxyethylene groups, oxypropylene groups and admixtures thereof, and the said oxyalkylene groups constitute at least 65% by weight of the compound.

17. The liquid surfactant composition of claim 16 wherein the hydrogen peroxide is present in an amount of about 0.01–0.5% by weight, and the surfactant composition contains from about 50% to 85% by weight of water.

18. The liquid surfactant composition of claim 17 wherein the said ratio of surfactant (1) to surfactant (2) is from about 1:2 to 2:1 and the said oxyalkylene groups constitute from about 70% to 80% by weight of the compound.

19. The liquid surfactant composition of claim 18 wherein $n$ is an integer having a numerical value of about 9.

20. The liquid surfactant composition of claim 19 wherein the said ratio of surfactant (1) to surfactant (2) is about 1:1, hydrogen peroxide is present in an amount of about 0.1% by weight, and the surfactant composition contains about 70% of water.

21. An acidic stock surfactant solution which is stable, homogeneous, mobile and compatible with alkaline aqueous washing media prepared by diluting the surfactant composition of claim 1 with water.

22. A stock surfactant solution prepared by diluting the surfactant composition of claim 2 with water.

23. A stock surfactant solution prepared by diluting the surfactant composition of claim 6 with water.

24. A stock surfactant solution prepared by diluting the surfactant composition of claim 11 with water.

25. A stock solution of surfactant prepared by diluting the surfactant composition of claim 16 with water.

26. A stock solution of surfactant prepared by diluting the surfactant composition of claim 18 with water.

27. A stock solution of surfactant prepared by diluting the surfactant composition of claim 20 with water.

28. In a method of washing soiled substrates wherein the substrate is intimately contacted with an aqueous medium containing a surfactant composition under conditions whereby at least a portion of the soil is removed therefrom, the improvement which comprises washing the said solid substrate in an alkaline aqueous medium containing (A) a surfactant composition in accordance with claim 1, and (B) a dissolved water-soluble alkaline substance substance providing at least one ion selected from the group consisting of ammonium, sodium and potassium ions in an amount to form the corresponding salt of the alkyl benzene sulfonic acid surfactant of (A).

29. The method of claim 28 wherein the said surfactant composition of (A) has a ratio of surfactant (1) to surfactant (2) from about 1:2 to 2:1.

30. The method of claim 28 wherein the said surfactant composition of (A) includes a nonionic surfactant which comprises an alkoxylate of an aliphatic alcohol corresponding to the structural formula:

$$R-O-(A)_n-H$$

wherein R is the organic residue of at least one aliphatic alcohol having from 8 to 20 carbon atoms, A is at least one oxyalkylene group, and *n* is an integer having a numerical value such that the oxyalkylene groups constitute more than 60% and up to about 95% by weight of the compound.

31. The method of claim 28 wherein the said surfactant composition of (A) includes at least 30% by weight of water.

32. The method of claim 30 wherein *n* is an integer having a numerical value of from about 6 to 11, at least 30% by weight of water is present in the surfactant composition, the said oxyalkylene groups are selected from the group consisting of oxyethylene groups, oxypropylene groups and admixtures thereof, and the said oxyalkylene groups constitute at least 65% by weight of the compound.

33. The method of claim 32 wherein the hydrogen peroxide is present in an amount of about 0.01–0.5% by weight, the surfactant composition contains from about 50% to 85% by weight of water, the said ratio of surfactant (1) to surfactant (2) is from about 1:2 to 2:1, and the said oxyalkylene groups constitute from about 70% to 80% by weight of the compound.

34. The method of claim 33 wherein *n* is an integer having a numerical value of about 9, the said ratio of surfactant (1) to surfactant (2) is about 1:1, hydrogen peroxide is present in an amount of about 0.1% by weight, and the surfactant composition contains about 70% of water.

35. In a method of washing soiled textile materials wherein textile material having an undersirable foreign substance thereon is agitated in an aqueous medium containing a surfactant under conditions whereby at least a portion of the foreign substance is removed, the improvement which comprises washing the said soiled textile material in an alkaline aqueous medium containing (A) a surfactant composition in accordance with claim 1, and (B) a water soluble alkaline substance which provides in solution at least one ion selected from the group consisting of ammonium ion, sodium ion, and potassium ion in an amount whereby the said alkyl benzene sulfonic acid surfactant of (A) is converted to the corresponding salt.

36. The method of claim 35 wherein the said surfactant composition of (A) has a ratio of surfactant (1) to surfactant (2) from about 1:2 to 2:1.

37. The method of claim 35 wherein the said surfactant composition of (A) includes a nonionic surfactant which comprises an alkoxylate of an aliphatic alcohol corresponding to the structural formula:

$$R-O-(A)_n-H$$

wherein R is the organic residue of at least one aliphatic alcohol having from 8 to 20 carbon atoms, A is at least one oxyalkylene group, and *n* is an integer having a numerical value such that the oxyalkylene groups constitute more than 60% and up to about 95% by weight of the compound.

38. The method of claim 35 wherein the said surfactant composition of (A) includes at least 30% by weight of water.

39. The method of claim 37 wherein *n* is an integer having a numerical value of from about 6 to 11, at least 30% by weight of water is present in the surfactant composition, the said oxyalkylene groups are selected from the group consisting of oxyethylene groups, oxypropylene groups and admixtures thereof, and the said oxyalkylene groups constitute at least 65% by weight of the compound.

40. The method of claim 39 wherein the hydrogen peroxide is present in an amount of about 0.01–0.5% by weight, the surfactant composition contains from about 50% to 85% by weight of water, the said ratio of surfactant (1) to surfactant (2) is from about 1:2 to 2:1, and the said oxyalkylene groups constitute from about 70% to 80% by weight of the compound.

41. The method of claim 40 wherein *n* is an integer having a numerical value of about 9, the said ratio of surfactant (1) to surfactant (2) is about 1:1, hydrogen peroxide is present in an amount of about 0.1% by weight, and the surfactant composition contains about 70% of water.

* * * * *